US012303025B2

(12) United States Patent
Lee et al.

(10) Patent No.: US 12,303,025 B2
(45) Date of Patent: May 20, 2025

(54) FOLDABLE DEVICE WITH LIFTING MECHANISM

(71) Applicant: Tsung-Ling Lee, Taipei (TW)

(72) Inventors: Tsung-Ling Lee, Taipei (TW); Chih-Peng Chou, New Taipei (TW)

(73) Assignee: Tsung-Ling Lee, Taipei (TW)

( * ) Notice: Subject to any disclaimer, the term of this patent is extended or adjusted under 35 U.S.C. 154(b) by 101 days.

(21) Appl. No.: 18/448,971

(22) Filed: Aug. 14, 2023

(65) Prior Publication Data

US 2024/0081523 A1 Mar. 14, 2024

(30) Foreign Application Priority Data

Sep. 8, 2022 (TW) ..... 111134063

(51) Int. Cl.
*A47B 5/04* (2006.01)

(52) U.S. Cl.
CPC ..... *A47B 5/04* (2013.01)

(58) Field of Classification Search
CPC ..... A47B 5/04; A47B 9/16
See application file for complete search history.

(56) References Cited

U.S. PATENT DOCUMENTS 1,515,242 A * 11/1924 Dexter ..... A47B 5/04 248/240.4
4,791,873 A * 12/1988 Towfigh ..... A47B 5/04 108/134
4,998,484 A * 3/1991 Groetzinger ..... A47B 5/04 108/115
5,381,738 A * 1/1995 Meyer ..... A47B 5/00 108/42
8,267,017 B1 * 9/2012 Michael ..... A47B 5/04 248/240.4
10,709,235 B1 * 7/2020 Brown ..... A47B 5/04
2015/0048228 A1 * 2/2015 Mullins ..... A47B 5/04 248/240.4
2016/0166055 A1 * 6/2016 Bo ..... A47B 3/002 108/42
2019/0375325 A1 * 12/2019 Zappolini ..... A47B 13/088
2022/0408910 A1 * 12/2022 Leng ..... A47B 3/0915

FOREIGN PATENT DOCUMENTS

CN 203913955 11/2014
DE 102016120521 A1 * 5/2018 ..... A47B 5/04
TW M636858 1/2023
WO WO-2018198059 A1 * 11/2018 ..... A47B 5/04

* cited by examiner

*Primary Examiner* — Daniel J Rohrhoff
(74) *Attorney, Agent, or Firm* — JCIPRNET

(57) ABSTRACT

A foldable device with a lifting mechanism includes at least one rail, a first sliding member, a second sliding member, a first linking member, a second linking member, and a latch structure. The first and the second sliding members are movably disposed on the rail, the first linking member is pivoted to the second sliding member, and the second linking member is pivoted to the first linking member and the first sliding member. The first and the second sliding members are combined with or departed from each other through a latch structure. The first and the second sliding members move closed to or away from each other to drive the first linking member to be folded onto or spread out from the rail when the first and the second sliding members are departed from each other.

12 Claims, 9 Drawing Sheets

FOLDABLE DEVICE WITH LIFTING MECHANISM

CROSS-REFERENCE TO RELATED APPLICATION

This application claims the priority benefit of Taiwan application serial no. 111134063, filed on Sep. 8, 2022. The entirety of the above-mentioned patent application is hereby incorporated by reference herein and made a part of this specification.

BACKGROUND

Field of the Disclosure

The present disclosure relates to a foldable device, and in particular to a foldable device with a lifting mechanism.

DESCRIPTION OF RELATED ART

In order to be designed with a simple appearance and functionality, modern furniture mostly are not provided with a conventional fixed structure, and adopts a foldable mechanism as the design basis, so as to be easy to store and save space when not in use.

However, these foldable mechanisms still have complex components, that is, the user needs to apply force to different components one by one, so that they may be smoothly adjusted to the unfolded or folded state for use. Not only that the operation process is complicated and inconvenient, it is also likely to cause component interference due to poor design or poor component tolerance.

SUMMARY OF THE DISCLOSURE

The present disclosure provides a foldable device, so that it is possible to switch between the folded state or the unfolded state through a single linear motion mode provided by the lifting mechanism.

In the disclosure, a foldable device with a lifting mechanism includes a rail, a first sliding member, a second sliding member, a first linking member, a second linking member, and a latch structure. The first sliding member and the second sliding member are respectively movably disposed on the rail, the first linking member is pivoted to the second sliding member, and the second linking member is pivoted to the first linking member and the first sliding member. The first sliding member and the second sliding member are combined with or departed from each other through a latch structure. The first sliding member and the second sliding member move closed to or away from each other to drive the first linking member to be folded onto or spread out from the rail when the first sliding member and the second sliding member are departed from each other. The first sliding member and the second sliding member move along the rail synchronously when the first sliding member and the second sliding member are combined with each other, and the first linking member is unfolded relative to the rail.

In an embodiment of the present disclosure, the rail is a straight rail.

In an embodiment of the present disclosure, the foldable device includes a pair of rails, and the first sliding member and the second sliding member are respectively arranged on the rails and move along two parallel paths.

In an embodiment of the present disclosure, the second sliding member has a friction force 1 with respect to the rail, there is a friction force 2 at the pivot joint between the first linking member and the second sliding member, there is a friction force 3 at the pivot joint between the first linking member and the second linking member, and there is friction force 4 at the pivot joint between the second linking member and the first sliding member, where the friction force 2, friction force 3 and friction force 4 are all less than the friction force 1.

In an embodiment of the present disclosure, the latch structure includes a latch and a holding pin, the latch is pivotally connected to the second sliding member, and the first sliding member has a holding pin, and the latch also has a guide surface and a buckle groove, so that when the first sliding member moves closer to the second sliding member, the holding pin is buckled in the buckle groove after passing through the guide surface.

In an embodiment of the present disclosure, the foldable device further includes an unlocking member located on a moving path of the latch, so that when the latch passes by the unlocking member, the latch is pushed by the unlocking member so that the holding pin moves from the buckle groove to separate the first sliding member from the second sliding member.

In an embodiment of the present disclosure, the unlocking member has a resisting surface, which is inclined relative to the moving path of the latch, and the terminal end of the resisting surface is away from the rail to push the latch away from the rail.

In an embodiment of the present disclosure, the first sliding member and the second sliding member are respectively lifted and lowered on the rail along the direction of gravity, and the second sliding member is located above the first sliding member along the direction of gravity. During combination and when the first linking member is in the unfolded state, the first sliding member and the second sliding member descend synchronously along the direction of gravity for a first stroke and then are separated from each other through the unlocking member.

In an embodiment of the present disclosure, after the separation, the first sliding member continues a second stroke along the direction of gravity to fold the first linking member.

In an embodiment of the present disclosure, the second sliding member has a base, a fin and a pivot portion, the base is fixed on the rail, the fin extends from the base, and the latch is pivotally connected to the fin to maintain a distance from the base. The pivot portion extends from the terminal end of the fin, and the terminal end is far away from the base, and the pivot portion is pivotally connected to the first linking member.

In an embodiment of the present disclosure, the first sliding member has a base and a fin, the base slidably passes through the rail, the fin extends from the base and passes through a slit of the rail, and the holding pin is arranged on the fin.

In an embodiment of the present disclosure, the first linking member includes a table board and at least one support frame, the support frame is assembled on the table board, and the support frame is pivotally connected to the second sliding member and the second linking member. In this manner, when the first sliding member moves closer to or away from the second sliding member, the table board rotates relative to the rail with the pivot joint between the support frame and the second sliding member as the center.

Based on the above, with the slidable linkage mechanism formed by the rail, the second sliding member, the first sliding member, the first linking member and the second linking member, when the rail is erected (in line with the direction of gravity), the foldable device may make its components to switch between folded state and unfolded state through the lifting action of the mechanism. In other words, the second sliding member and the first sliding member are able to slide to move closer to or farther away from each other to achieve the effect of rotating the components to be folded or unfolded in this simple motion mode.

DESCRIPTION OF EMBODIMENTS

Figure 1:
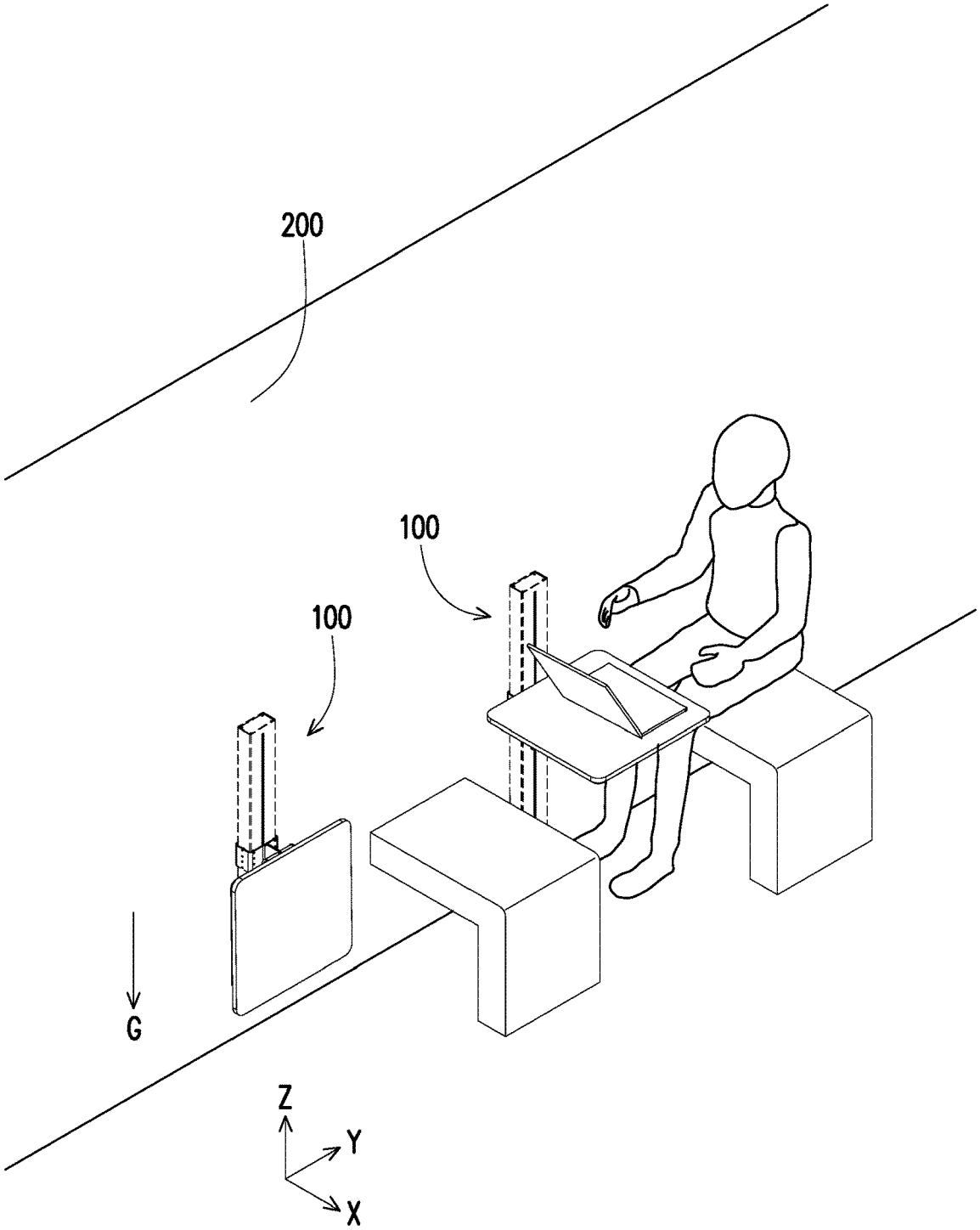
FIG. 1 is a schematic diagram of using a foldable device according to an embodiment of the present disclosure.
Figure 2A:
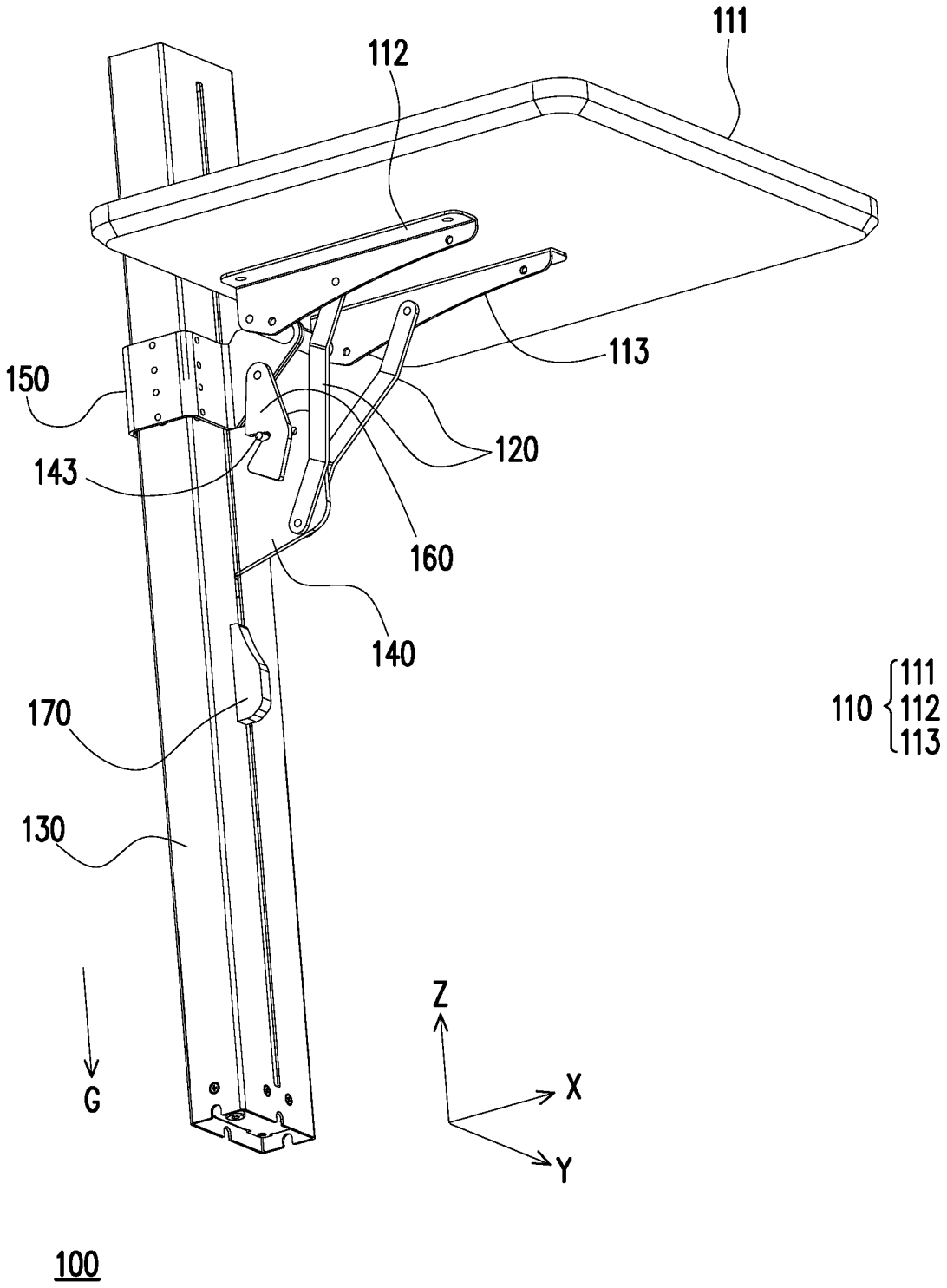
FIG. 2A is a schematic diagram of a foldable device in an unfolded state.

FIG. 1 is a schematic diagram of using a foldable device according to an embodiment of the present disclosure. FIG. 2A is a schematic diagram of a foldable device in an unfolded state. Cartesian coordinates X-Y-Z are also provided here to facilitate description of components. Please refer to FIG. 1 and FIG. 2A at the same time. In this embodiment, a foldable device 100 with a lifting mechanism (hereinafter referred to as the foldable device 100) is used for switching between different states. As shown in FIG. 2A, the foldable device 100 includes a first linking member 110, a second linking member 120, a rail 130, a first sliding member 140, a second sliding member 150, a latch structure and an unlocking member 170. The first linking member 110 is pivotally connected to the second sliding member 150, and the second linking member 120 is pivotally connected to the first linking member 110 and the first sliding member 140. The first sliding member 140 is movably arranged on the rail 130, and the second sliding member 150 is fixed on the rail 130, and make the first sliding member 140 move along the rail 130 to move closer to or away from the second sliding member 150. Through the connection relationship of the above-mentioned components, the foldable device 100 has a movement mode of a slidable linkage mechanism. That is, during the movement of the first sliding member 140 along the rail 130, it is possible to cause the first linking member 110 to rotate relative to the wall 200 (or rail 130) to form the folded (folding) state shown on the left side of FIG. 1, or the unfolded state shown on the right side of FIG. 1. Conversely, the sliding linkage mechanism may also achieve its motion mode through the user applying force to drive the first linking member 110.

In other words, under the use situation shown in FIG. 1, the foldable device 100 is adaptable for embedding its rail 130 in the wall 200, and only the driving mechanism and the part operated by the user are exposed outside the wall 200, which in turn creates a visually hidden effect and facilitates utilization of space. However, the present disclosure does not limit the use scenarios of the foldable device 100, and the designer may make appropriate adjustments according to the use environment and requirements under the condition that the use situation of the foldable device 100 conforms to the movement mode described in the present disclosure. For example, taking hidden (storage) furniture as an example, in another embodiment not shown, the foldable device may also be applied to a display screen to have both display and storage functions. In another non-illustrated embodiment, the foldable device may also be adjusted as a foldable seat. To put it simply, those who conform to the subsequent movement modes of the first linking member 110, the second linking member 120, the rail 130, the first sliding member 140, the second sliding member 150, the latch structure and the unlocking member 170 are not limited to the lifting action shown in FIG. 1. For example, the rail 130 is embedded in the ceiling to be in a horizontal state (perpendicular to the direction of gravity G) so as to facilitate the aforementioned display or storage of the display screen.

Figure 2B:
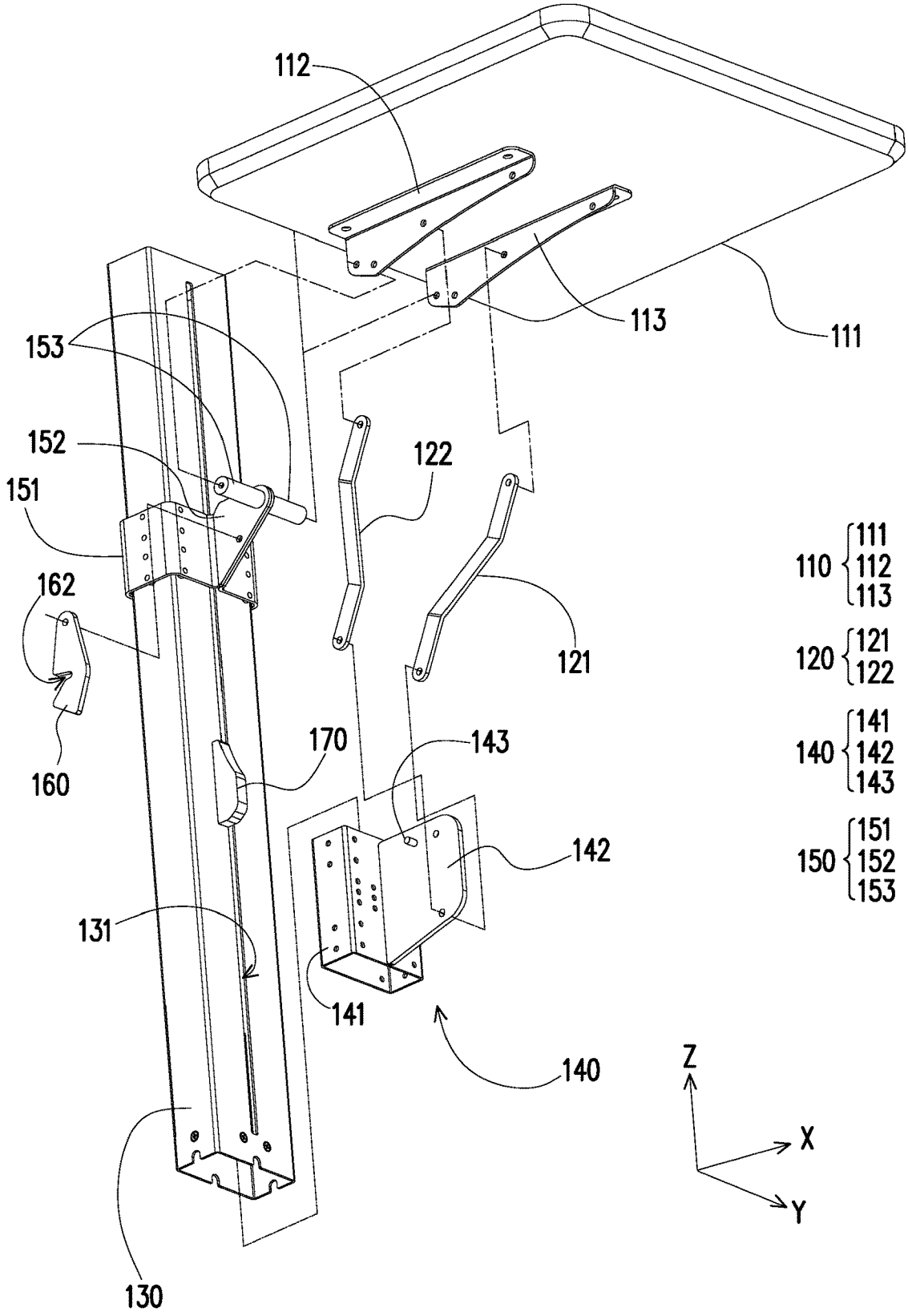
FIG. 2B is an exploded view of the foldable device of FIG. 2A.

FIG. 2B is an exploded view of the foldable device of FIG. 2A. Please refer to FIG. 2A and FIG. 2B at the same time. In detail, the rail 130 of this embodiment is a straight rail, so that the motion mode generated by the first sliding member 140 coupled thereon is a straight moving path. Furthermore, when the foldable device 100 is in the use situation shown in FIG. 1, the moving path of the first sliding member 140 is actually parallel to the direction of gravity G. It should also be mentioned that the disclosure does not limit the driving method of the first sliding member 140 on the rail 130. Because of the above-mentioned component relationship of the foldable device 100, the designer may allow the user to exert force on the first linking member 140 as mentioned above to manually complete the folding or unfolding action. In another embodiment, it is also possible to embed a motor and a conveyor belt in the rail 130, and using electric power (or motor) instead to drive the first sliding member 140 to achieve the folding or unfolding action of the first linking member 110.

Please refer to FIG. 2B again. The second sliding member 150 of this embodiment has a second base 151, a second fin 152 and a pivot portion 153. The second base 151 is fixedly sleeved outside the rail 130. The second fin 152 extends from the second base 151, the pivot portion 153 extends from the terminal end of the second fin 152, the terminal end is away from the second base 151, and the pivot portion 153 is pivotally connected to the first linking member 110. The first sliding member 140 of this embodiment has a first base 141 and a first fin 142, the first base 141 slidably passes through the rail 130, the first fin 142 extends from the first base 141 and extends from a slit 131 of the rail 130, and the second linking member 120 is pivotally connected to the first fin 142.

Moreover, the first linking member 110 of this embodiment includes a table board 111 and at least one support frame (take two support frames 112 and 113 as an example here), the support frames 112 and 113 are assembled on the bottom surface of the table board 111, and the support frames 112 and 113 are pivotally connected to the second fin 152 of the second sliding member 150 and the second linking member 120. The second linking member 120 is composed of two parts 121 and 122, and one end of the parts 121 and 122 is correspondingly pivoted (or pinned) to the support frames 112 and 113, and the other end of the parts 121 and 122 is pivoted (or pinned) to two opposite surfaces of the first fin 142 of the first sliding member 140. In addition, as mentioned above, the table board 111 of this embodiment may also be replaced by a display screen or a seat.

The aforementioned slidable linkage mechanism is generated based on the above-mentioned component relationship, so that when the first sliding member 140 moves closer to or away from the second sliding member 150, the table board 111 rotates relative to the rail 130 around the pivot joint (equivalent to the pivot portion 153) between the support frames 112 and 113 and the second sliding member 150. The table board 111 rotates relative to the rail 130 to switch between the folded state (as shown on the left side of FIG. 1) and the unfolded state (as shown on the right side of FIG. 1, FIG. 2A or FIG. 2B). In the folded state, the table board 111 is parallel to the rail 130 (or the wall 200), and in the unfolded state, the table board 111 is perpendicular to the rail 130 (or the wall 200).

Please refer to FIG. 2A and FIG. 2B at the same time. In order to maintain the folded state, the latch structure of this embodiment includes a latch 160 and a holding pin 143. The latch 160 is pivotally connected to the second fin 152 of the second sliding member 150. The holding pin 143 is located on the first fin 142 and extends along the Y axis. The latch 160 has a guide surface 161 and a buckle groove 162. When the first sliding member 140 moves closer to the second sliding member 150, the holding pin 143 travels through the guide surface 161 and stops at the buckle groove 162, as shown in FIG. 2A. Furthermore, the guide surface 161 of this embodiment is in the shape of "<" and has a first segment C1 and a second segment C2, and the first segment C1 is in adjacency between the buckle groove 162 and the second segment C2. Here, the extending direction of the holding pin 143 and the pivoting direction of the latch 160 relative to the second sliding member 150 are parallel to each other (both are parallel to the Y axis). The latch 160 also has a stop surface 163, and the buckle groove 162 is in adjacency between the stop surface 163 and the guide surface 161. The unlocking member 170 of the foldable device 100 is fixed on the rail 130 and adjacent to the slit 131, the latch 160 is used to lean against the unlocking member 170 to keep a distance from the rail 130, and the guide surface 161 is seated on the moving path of the holding pin 143, further explanation will be provided below.

FIG. 3A to FIG. 3E illustrate the state transition process of the foldable device in a side view. Please refer to FIG. 3A to FIG. 3E at the same time. In this embodiment, the rail 130 is adapted to be arranged along the direction of gravity G, so that the first sliding member 140 is able to fold or unfold the table board 111 through the reciprocating linear lifting action along the direction of gravity G. Here, the second sliding member 150 is disposed above the first sliding member 140. Certainly, as mentioned above, the disclosure does not limit the driving method of the first sliding member 140, therefore, the user may also drive the table board 111, and the effect of the relationship between the aforementioned components produces the effect of driving the first sliding member 140 to move along the rail 130.

Figure 3A:
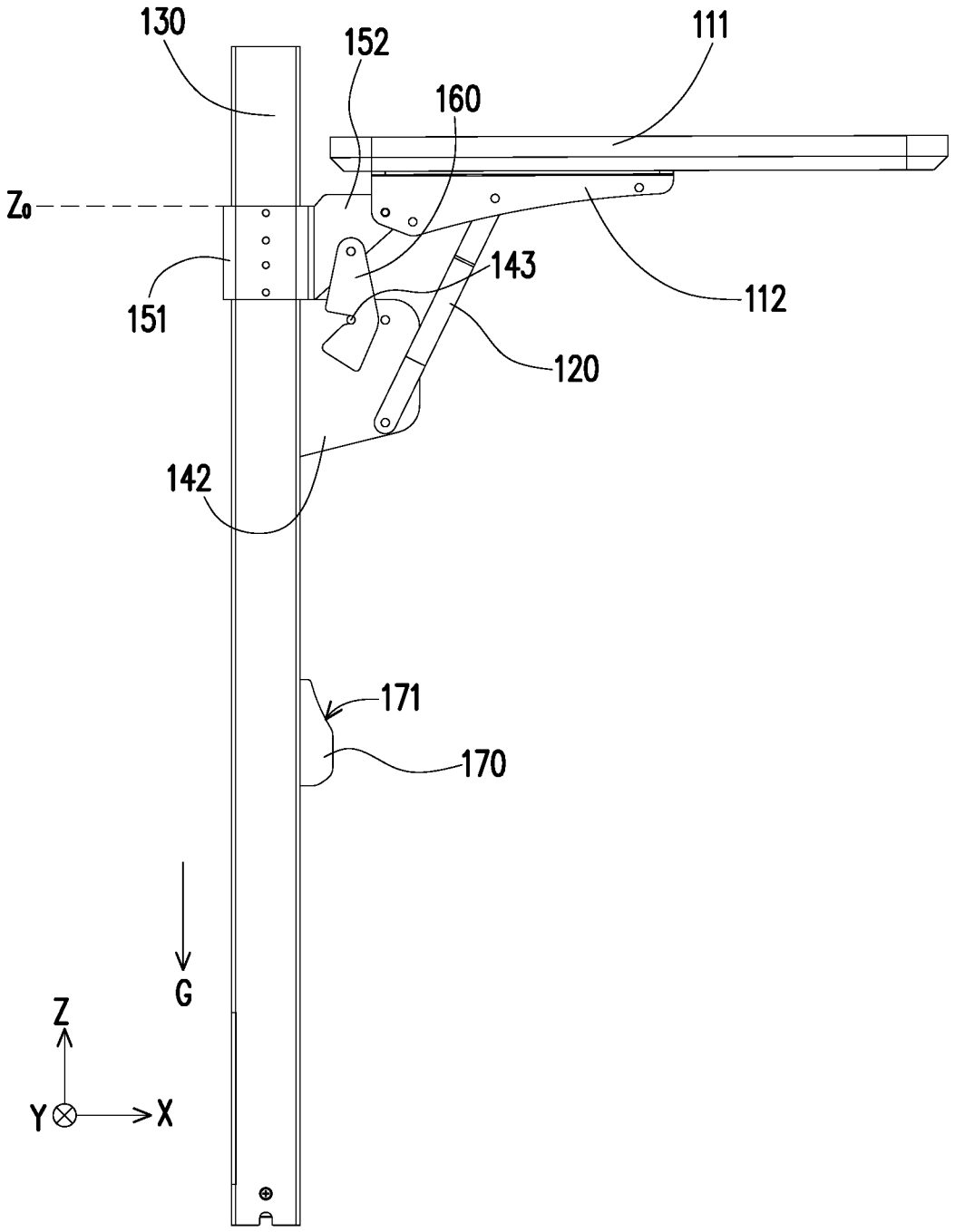
FIG. 3A to FIG. 3E illustrate the state transition process of the foldable device in a side view.
Figure 3B:
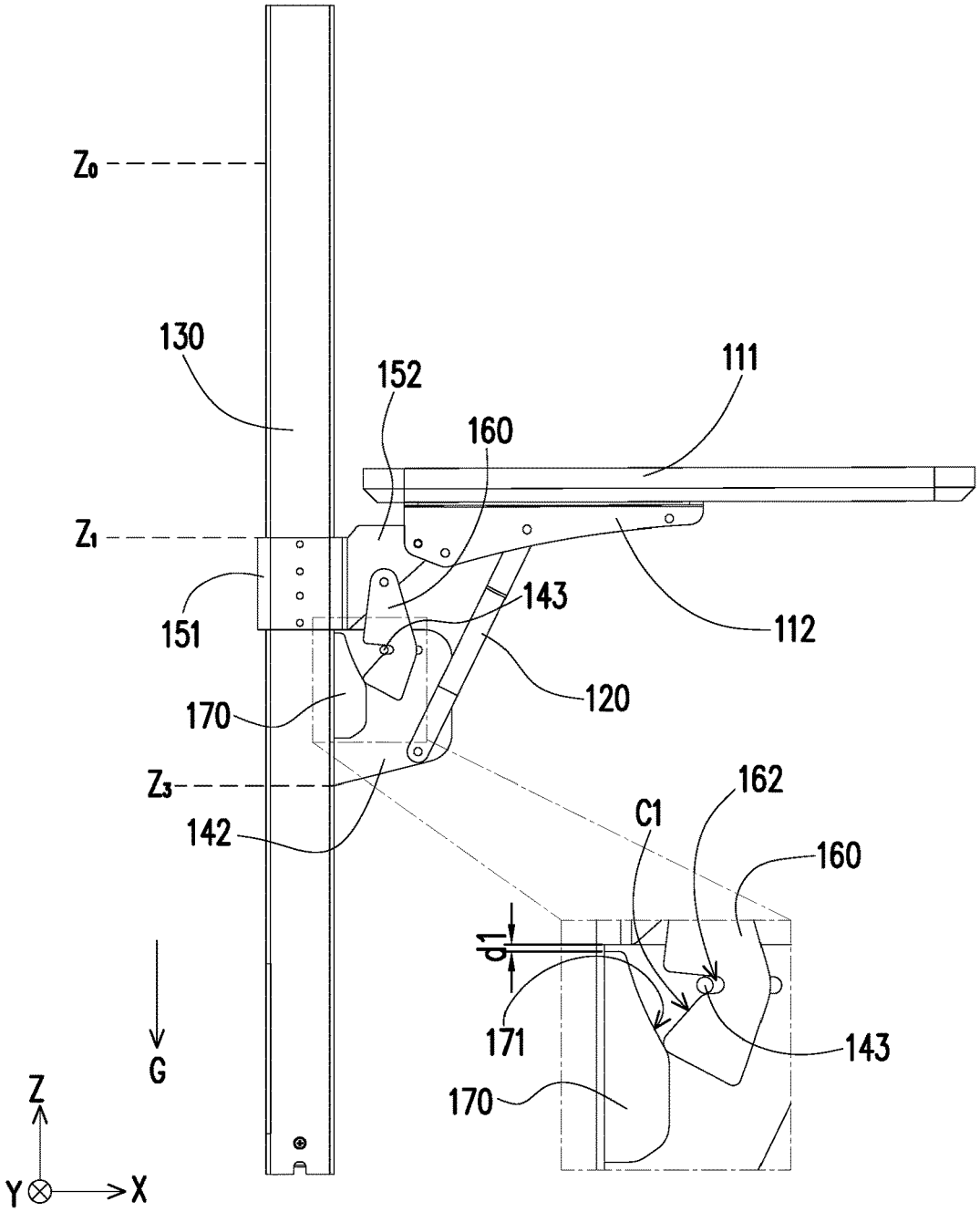

First, as shown in FIG. 3A to FIG. 3B, since the first sliding member 140 and the second sliding member 150 are combined together by the latch structure, and the latch structure further enables the first linking member 110 to maintain the unfolded state relative to the rail 130. In this state, the first sliding member 140, the second sliding member 150, the first linking member 110 and the second linking member 120 are substantially considered as one and move synchronously along the rail 130. The second sliding member 150 is equivalent to moving from position $Z_0$ to position $Z_1$.

Figure 3C:
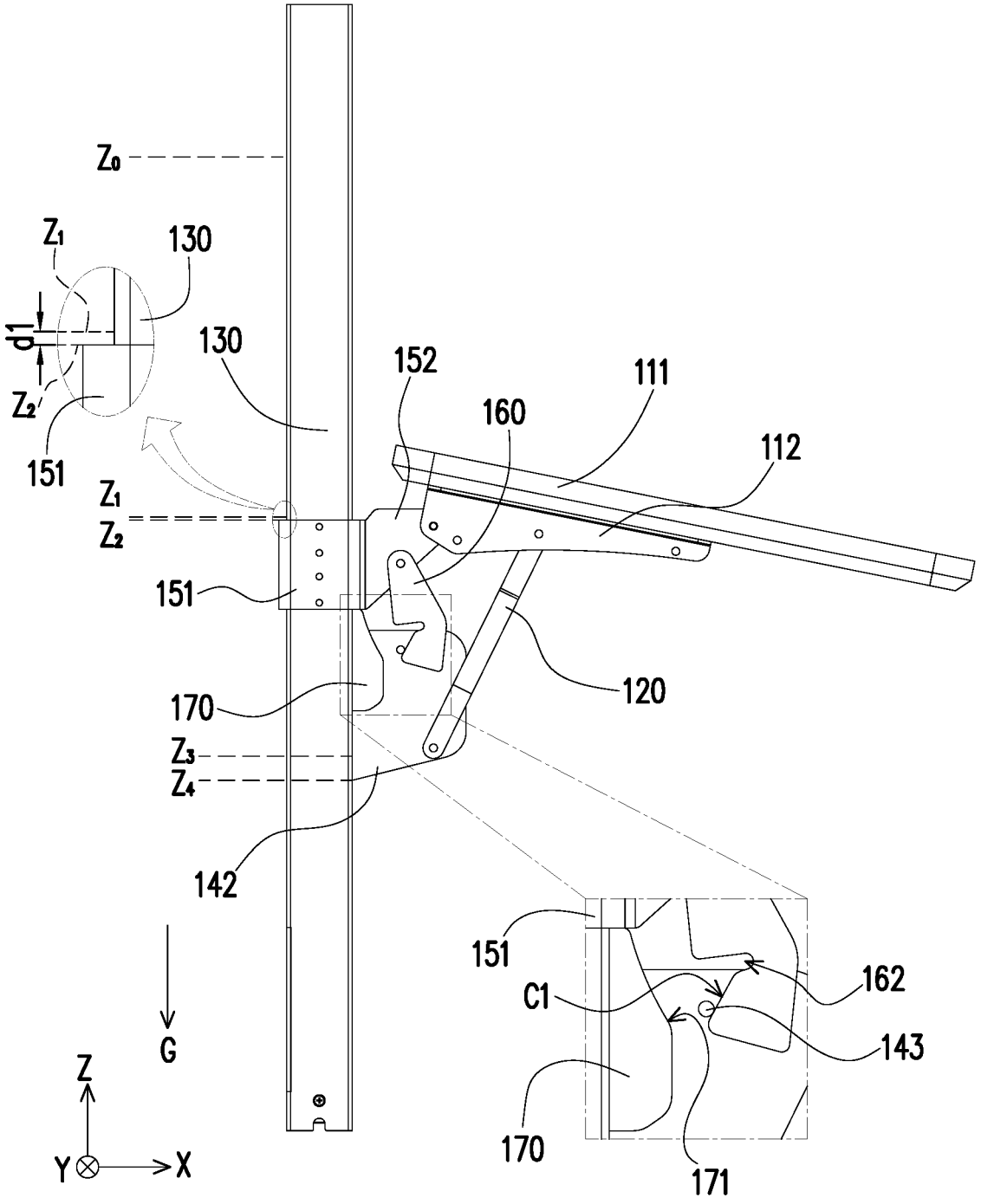
Figure 3D:
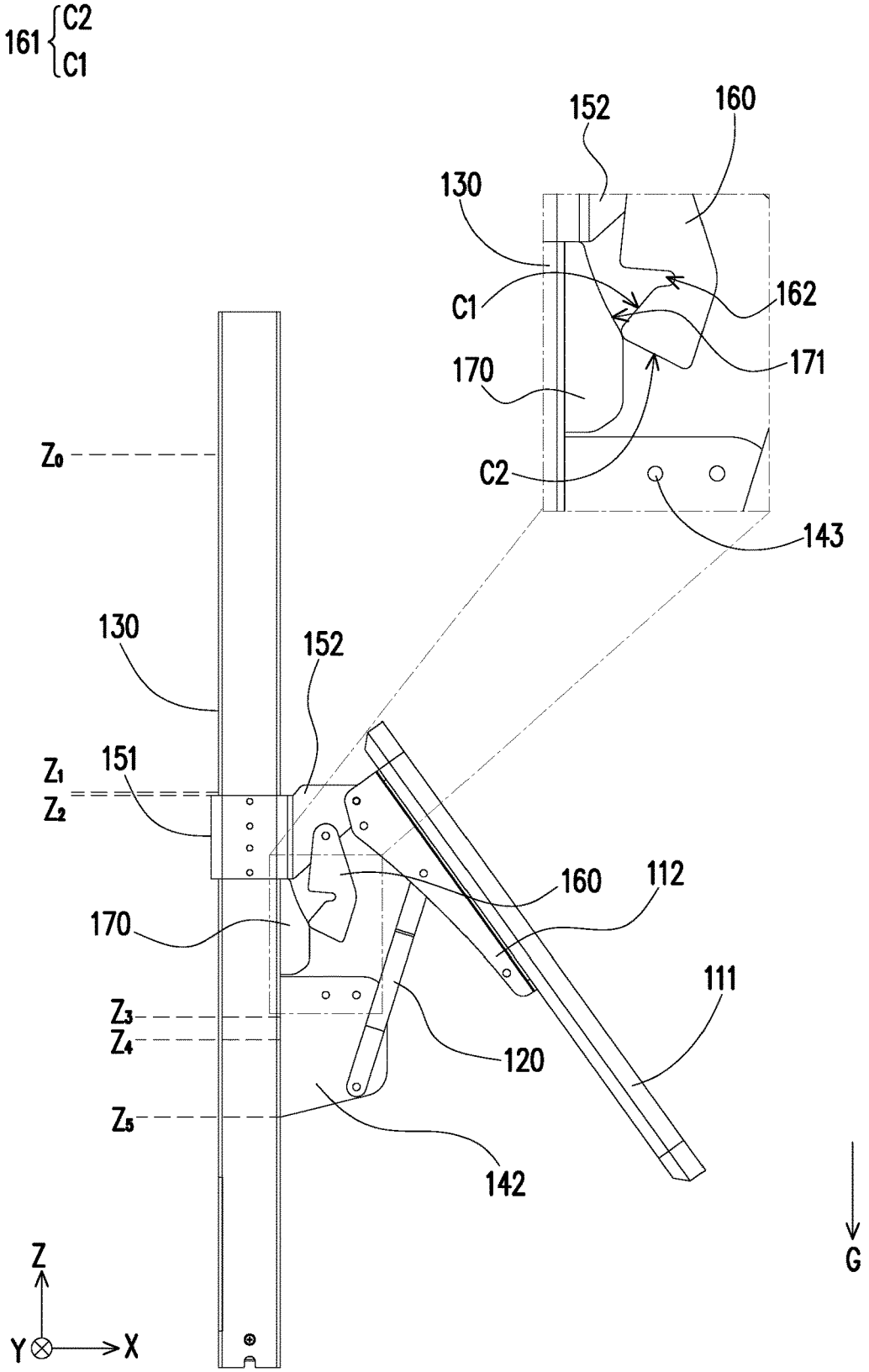

Next, please refer to FIG. 3B to FIG. 3C, due to the blocking of the unlocking member 170, the second sliding member 150 moves to the position $Z_2$ and then stops there, the distance d1 shown in FIG. 3B exists between the unlocking member 170 and the second sliding member 150. Therefore, the relative distance from the position $Z_1$ to the position $Z_2$ shown in FIG. 4B is also shown as the distance d1 to denote the moving distance of the second sliding member 150 (equivalent to the distance d1) during the process from FIG. 3B to FIG. 3C.

It is worth noting that in the process from FIG. 3B to FIG. 3C, the first sliding member 140 has moved from position $Z_3$ to position $Z_4$, and its moving distance is significantly greater than the distance d1. Because the latch 160 has been pushed away by the surface 171 of the unlocking member 170 and released from the holding relationship with the holding pin 143, whether the user continues to apply force to the table board 111 or the motor drives the first sliding member 140 to move in the direction of the negative Z-axis, it is possible for the table board 111 of the first linking member 110 to rotate toward the rail 130 and then retract, and perform the folding process from FIG. 3C to the state in FIG. 3D and FIG. 3E in sequence.

In other words, the first sliding member 140 and the second sliding member 150 actually move up and down on the rail 130 along the direction of gravity G. When the first sliding member 140 and the second sliding member 150 are in a combined state, the first sliding member 140 and the second sliding member 150 descend synchronously along the direction of gravity G for the first stroke and then are unlocked and separated from each other by the unlocking member 170. The first stroke is equivalent to the second sliding member 150 moving from the position $Z_0$ to the position $Z_2$. After the separation, the first sliding member 140 continues to travel along the direction of gravity G for a second stroke to fold the table board 111, and the second stroke is equivalent to the first sliding member 140 traveling from the position $Z_3$ to the position $Z_5$ all the way.

In addition, the latch 160 of this embodiment is freely pivoted to the second fin 152 along the Y axis and keeps a distance from the second base 151 (or the rail 130). In order to ensure that the holding pin 143 on the first fin 142 is able to drive the latch 160 smoothly when the first sliding member 140 moves and prevent the latch 160 from deviating from the moving path of the holding pin 143 due to the influence of the center of gravity, in this embodiment, by setting an unlocking member 170 on the rail 130, the latch 160 is able to lean against the unlocking member 170 and keep a distance from the rail 130 (or the second base 151), which is equivalent to maintaining the guide surface 161 of the latch 160 on the moving path of the holding pin 143 through the unlocking member 170. The above support situation occurs when the holding pin 143 is located at the buckle groove 162 or away from the guide surface 161, and the latch 160 leans against the unlocking member 170. Once the holding pin 143 is in contact with the guide surface 161, the above problem may be ignored, that is, the latch 160 is driven away from the unlocking member 170 by the driving of the holding pin 143 at this time.

In another embodiment that is not shown, a spring may also be connected between the latch 160 and the second sliding member 150 to provide the latch 160 with the pre-force required to maintain the aforementioned position (make the latch 160 directly face the moving path of the first sliding member 140).

Because the moving path of the first sliding member 140 (and its holding pin 143) is consistent with the direction of gravity G, the guide surface 161 needs to be as close to the direction of gravity G as possible to perform its guiding function.

Figure 3E:
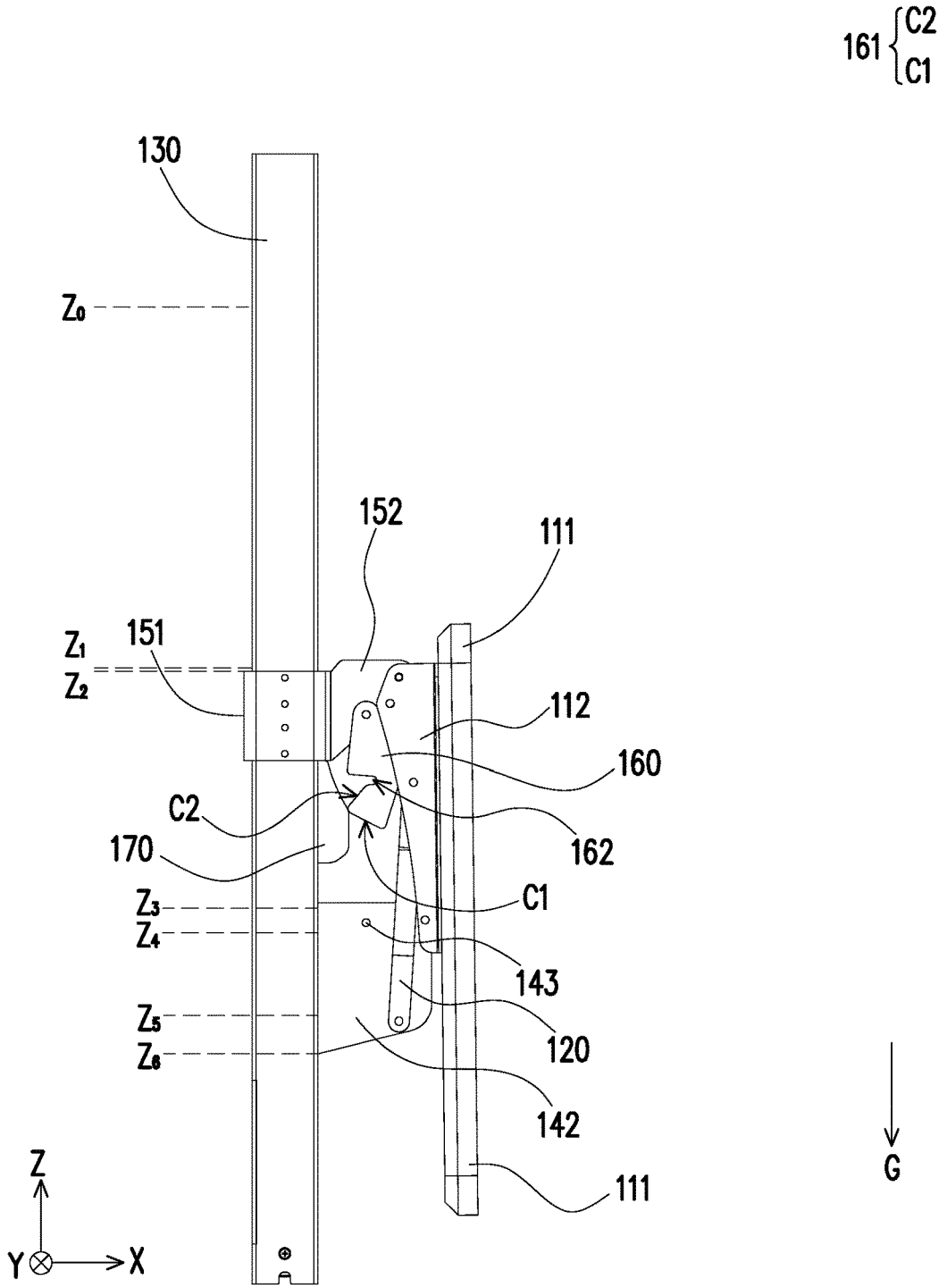

Conversely, when the user performs operation in reverse order, that is, executes the steps from FIG. 3E to FIG. 3A, the foldable device 100 may be unfolded again, and after the first sliding member 140 is combined with the second sliding member 150 by the latch structure, it is possible for the first sliding member 140, the second sliding member 150, the first linking member 110 and the second linking member 120 to be integrated and move along the rail 130 synchronously. During the above unfolding process, the second sliding member 150 has a friction force 1 with respect to the rail 130, there is a friction force 2 at the pivot joint between the first linking member 110 and the second sliding member 150, there is a friction force 3 at the pivot joint between the first linking member 110 and the second linking member 120, and there is friction force 4 at the pivot joint between the second linking member 120 and the first sliding member 140, where the friction force 2, friction force 3 and friction force 4 are all less than the friction force 1, so that the foldable device 100 first unfolds the table board 111 as shown in FIG. 3B, and then moves along the rail 130 synchronously. In another embodiment that is not shown, there is a convex hull structure between the rail 130 and the second sliding member 150, which may be arranged on the rail 130 or the second sliding member 150, so as to achieve the above-mentioned relationship of friction, and to ensure that the second sliding member 150 does not move during the unfolding process of the table board 111.

Figure 4:
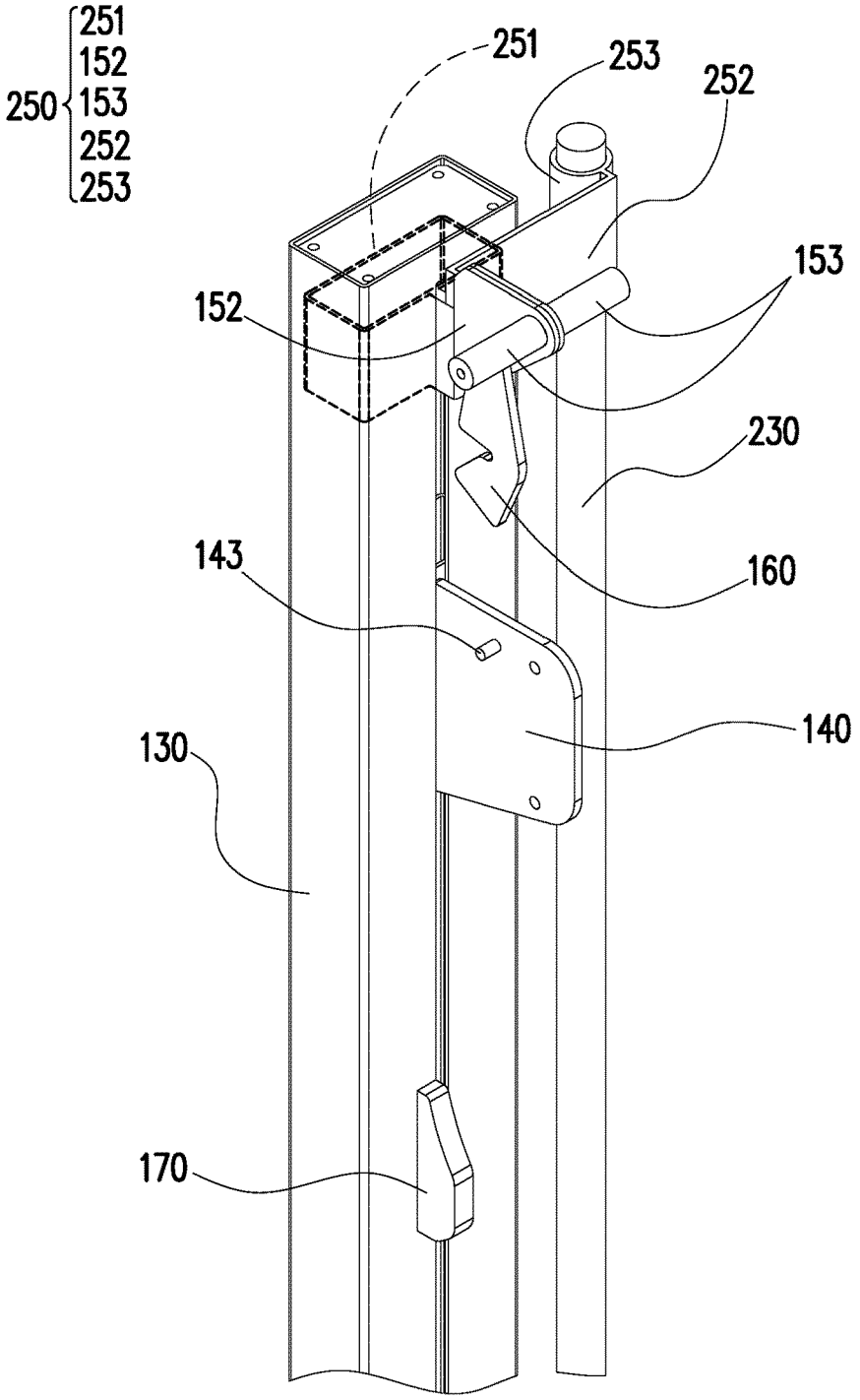
FIG. 4 is a schematic diagram of some components of a foldable device according to another embodiment of the present disclosure.

FIG. 4 is a schematic diagram of some components of a foldable device according to another embodiment of the present disclosure. Please refer to FIG. 4, different from the previous embodiments, the foldable device of this embodiment includes two rails 130 and 230, and the first sliding member 140 is slidably configured on the rail 130, while the second sliding member 250 is movably configured on the rail 230. Here, the rails 130 and 230 are two straight rails parallel to each other, so that the moving paths of the first sliding member 140 and the second sliding member 250 are also straight paths parallel to each other. Furthermore, the second sliding member 250 includes a second base 251, a second fin 152, a pivot portion 153, an extending portion 252 and a sleeve 253. Compared with the previous embodiment, the second base 251 is changed to movably passes through the rail 130, the extending portion 252 extends from the second fin 152 toward another rail (rail 230), and is sleeved on the rail 230 with the sleeve 253. The other structures are still the same as the previous embodiment, so they are omitted and the description is not repeated.

To sum up, in the above-mentioned embodiment of the present disclosure, with the slidable linkage mechanism formed by the rail, the second sliding member, the first sliding member, the first linking member and the second linking member, when the rail is erected (in line with the direction of gravity), the foldable device may make its components to switch between folded state and unfolded state through the lifting action of the mechanism. In other words, the second sliding member and the first sliding member are able to slide along the paths parallel with each other to move closer to or farther away from each other, so as to achieve the effect of rotating the components to be folded or unfolded in this simple motion mode. Furthermore, the rail of the foldable device is a straight rail, so the relative movement between the second sliding member and the first sliding member is a straight movement, and this simple movement mode may smoothly cause the table board of the first linking member to fold or unfold, which helps to simplify the components and their movement modes, thus preventing causing inconvenience to users due to complicated operations.

Moreover, the foldable device also includes a latch structure. In an embodiment, the latch structure is composed of a latch and holding pin, where the relative configuration of the latch and holding pin is designed in a way to allow the table board of the first linking member to be smoothly maintained at the unfolded state. When the first sliding member and the second sliding member are combined with each other due to the latch structure, the first sliding member, the second sliding member, the first linking member and the second linking member may be regarded as one, and then move along the rail synchronously. When the first sliding member and the second sliding member are separated from each other due to the latch structure, the state of folding or unfolding the table board may be achieved by moving the first sliding member and the second sliding member closer to or farther away from each other.

In addition, an unlocking member is provided on the rail, so that when the latch passes the surface of the unlocking member, the latch is pushed away from the holding pin to complete the unlocking, and at the same time, the unlocking member may further stop the second sliding member, so as to facilitate the first sliding member to continue moving and move away from the second sliding member. Furthermore, when the guide surface of the latch is not in contact with the holding pin, the foldable device further provides an unlocking member arranged on the rail, so that the latch may rest on the unlocking member and keep the guide surface of the latch at the moving path of the holding pin, thereby ensuring that the locking or unlocking function of the latch is able to be executed smoothly.

What is claimed is:

1. A foldable device with a lifting mechanism, comprising:

at least one rail;

a first sliding member, movably disposed on the rail;

a second sliding member, movably disposed on the rail;

a first linking member, pivoted to the second sliding member; and a second linking member, pivoted to the first linking member and the first sliding member; and a latch structure, configured to combine or separate the first sliding member and the second sliding member, wherein the first sliding member and the second sliding member move closed to or away from each other to drive the first linking member to be folded onto or spread out from the rail when the first sliding member and the second sliding member are departed from each other, the first sliding member and the second sliding member move along the rail synchronously when the first sliding member and the second sliding member are combined with each other, and the first linking member is unfolded relative to the rail.

2. The foldable device with the lifting mechanism according to claim 1, wherein the rail is a straight rail.

3. The foldable device with the lifting mechanism according to claim 1, comprising two rails, and the first sliding member and the second sliding member are respectively arranged on the two rails and move along two parallel paths.

4. The foldable device with the lifting mechanism according to claim 1, wherein the second sliding member has a friction force 1 with respect to the rail, there is a friction force 2 at a pivot joint between the first linking member and the second sliding member, there is a friction force 3 at a pivot joint between the first linking member and the second linking member, and there is friction force 4 at a pivot joint between the second linking member and the first sliding member, wherein the friction force 2, the friction force 3 and the friction force 4 are all less than the friction force 1.

5. The foldable device with the lifting mechanism according to claim 1, wherein the latch structure comprises a latch and a holding pin, the latch is pivotally connected to the second sliding member, and the first sliding member has the holding pin, and the latch further has a guide surface and a buckle groove, so that when the first sliding member moves closer to the second sliding member, the holding pin is buckled in the buckle groove after passing through the guide surface.

6. The foldable device with the lifting mechanism according to claim 5, further comprising an unlocking member located on a moving path of the latch, so that when the latch passes by the unlocking member, the latch is pushed by the unlocking member so that the holding pin moves from the buckle groove to separate the first sliding member from the second sliding member.

7. The foldable device with the lifting mechanism according to claim 6, wherein the unlocking member has a resisting surface, which is inclined relative to a moving path of the latch, and a terminal end of the resisting surface is away from the rail to push the latch away from the rail.

8. The foldable device with the lifting mechanism according to claim 6, wherein the first sliding member and the second sliding member are respectively lifted and lowered on the rail along a direction of gravity, and the second sliding member is located above the first sliding member along the direction of gravity, during the combination and when the first linking member is in the unfolded state, the first sliding member and the second sliding member descend synchronously along the direction of gravity for a first stroke and then are separated from each other through the unlocking member.

9. The foldable device with the lifting mechanism according to claim 8, wherein after the separation, the first sliding member continues a second stroke along the direction of gravity to fold the first linking member.

10. The foldable device with the lifting mechanism according to claim 5, wherein the second sliding member has a second base, a second fin and a pivot portion, the second base is fixed on the rail, the second fin extends from the second base, and the latch is pivotally connected to the second fin to maintain a distance from the second base, the pivot portion extends from a terminal end of the second fin, and the terminal end is far away from the second base, and the pivot portion is pivotally connected to the first linking member.

11. The foldable device with the lifting mechanism according to claim 5, wherein the first sliding member has a first base and a first fin, the first base slidably passes through the rail, the first fin extends from the first base and passes through a slit of the rail, and the holding pin is arranged on the first fin.

12. The foldable device with the lifting mechanism according to claim 1, wherein the first linking member comprises a table board and at least one support frame, the support frame is assembled on the table board, and the support frame is pivotally connected to the second sliding member and the second linking member, so that when the first sliding member moves closer to or away from the second sliding member, the table board rotates relative to the rail with a pivot joint between the support frame and the second sliding member as a center.

* * * * *